United States Patent [19]

Scheurecker

[11] 4,316,494

[45] Feb. 23, 1982

[54] SUPPORTING AND GUIDING STAND ARRANGEMENT TO BE USED IN A BOW-TYPE CONTINUOUS CASTING PLANT

[75] Inventor: Werner Scheurecker, Linz, Austria

[73] Assignee: Voest-Alpine Aktiengesellschaft, Linz, Austria

[21] Appl. No.: 124,533

[22] Filed: Feb. 25, 1980

[30] Foreign Application Priority Data

Mar. 7, 1979 [AT] Austria ..... 1725/79

[51] Int. Cl.[3] ..... B22D 11/00

[52] U.S. Cl. ..... 164/448

[58] Field of Search ..... 164/442, 448; 193/35 R; 226/189, 194

[56] References Cited

U.S. PATENT DOCUMENTS 3,989,092 11/1976 Lambin ..... 164/442 X
3,994,334 11/1976 Schrewe ..... 164/448

FOREIGN PATENT DOCUMENTS 345492 9/1978 Austria .
1286699 1/1969 Fed. Rep. of Germany ..... 164/448
2372669 8/1978 France ..... 164/448

*Primary Examiner*—Gus T. Hampilos
*Attorney, Agent, or Firm*—Brumbaugh, Graves, Donohue & Raymond

[57] ABSTRACT

A supporting and guiding stand for a bow-type continuous casting plant comprises exchangeable supporting segments in which the rollers of the oppositely arranged inner and outer guideways are mounted at a distance from one another. The segments are supported on a carrying frame, which advantageously is dividedly designed. On each segment at least one rim-side roller of the outer guideway is detachably fastened to the segment.

3 Claims, 2 Drawing Figures

SUPPORTING AND GUIDING STAND ARRANGEMENT TO BE USED IN A BOW-TYPE CONTINUOUS CASTING PLANT

BACKGROUND OF THE INVENTION

The invention relates to a supporting and guiding stand for a bow-type continuous casting plant comprising exchangeable supporting segments in which the rollers of the oppositely arranged inner and outer guideways are mounted at a distance from one another. The segments are supported on a carrying frame, which advantageously is dividedly designed.

Supporting and guiding stands of this kind are already known from German Pat. No. 24 25 883. With this known stand, a guiding roller is provided for each segment, which roller is independent from the segment and is fixedly mounted in a bearing bracket on the carrying frame. The individual segments, in case of repair, are pulled up along removal rails and are then led to the workshop by means of a crane. Repaired or exchange segments are again inserted in the same way via the removal rails, the difficulty being that the segments have to be newly adjusted relative to the fixedly mounted roller, which is accordingly time consuming.

A further disadvantage of the known stand is that an uneven wear occurs between the roller which is fixedly mounted on the carrying frame and those rollers which have been serviced in the workshop, resulting in deviations from the guideway prescribed and thus in quality losses of the surface of the strand.

SUMMARY OF THE INVENTION

The invention aims at avoiding these difficulties and disadvantages and has as its object to provide a supporting and guiding stand for a bow-type continuous casting plant, with which it is possible to rapidly exchange the individual supporting segments towards the inner side of the arc and wherein all the rollers of the segment constitute a unit that is adjusted without adjustment manipulations relative to the carrying frame being necessary when exchanging a segment.

The invention solves the object with a supporting and guiding stand of the initially-defined kind in which at least one rim-side or run-in side roller of the outer guideway is detachably fastened on each segment.

Advantageously, the detachable roller is mounted on a beam extending transversely to the carrying frame, the beam being insertable into a recess provided at the carrying frame, after being detached from the segment.

Suitably, the parts of the divided carrying frame are mounted in a fixed bearing and in an expansion bearing directed concentrically or tangentially to the bow curvature.

BRIEF DESCRIPTION OF THE DRAWINGS

The invention will be explained in more detail by way of one embodiment and with reference to the accompanying drawings, wherein.

DESCRIPTION OF THE ILLUSTRATIVE EMBODIMENT

Figure 1:
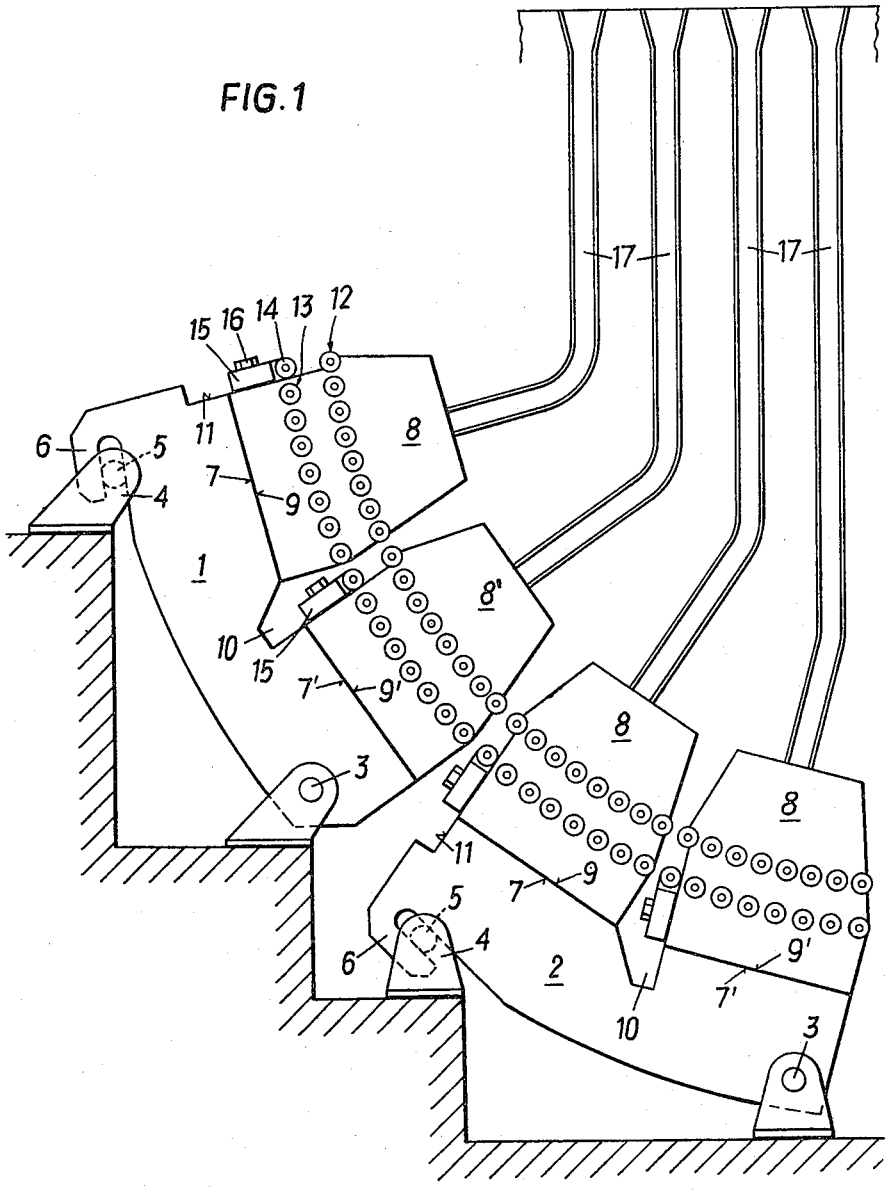
FIG. 1 is a schematic side view of part of the guiding arc having a circular arc-shaped cross section in the installed state, i.e. in a state ready for casting.

In FIG. 1 neighbouring parts 1 and 2 of the carrying frame are mounted in pivotable fixed bearings 3 and in expansion bearings 4 comprising bolts 5 and hook-shaped parts 6. The hook-shaped part 6 of these carrying frame parts comprises a slot which is directed in the direction of the curvature or tangent of the arc, so that, in case of heat influences, an expansion of the carrying frame parts can take place without displacements. The carrying frame parts include supporting faces 7, 7' which are machined towards the inside of the arc and on which one segment 8, 8' each is supported. These segments have machined counter faces 9, 9' that mate with the faces 7, 7' so that the installation of the individual segments is easily feasible without requiring fitting operations during an exchange. Between the faces 7, 7' there is a pocket 10 of trapezoidal cross section. A further pocket or recess 11 of rectangular cross section is provided on the front face of each of the neighbouring segments. In the segments 8, 8' the rollers 12 of the inner guideway and the rollers 13 of the outer guideway are mounted opposite one another and at a distance from each other. Each rim-side or run-in side first roller, which is denoted by 14, is detachably fastened to the segment in such a manner that it rests on a transverse beam 15, which in turn is fastenable to the segment by screws 16. However, instead of only one roller it is also possible to mount two or more rollers of the outer guideway on the beam 15, which is advantageous if, in the case of a narrow roller separation and great strand thicknesses, the space is limited. It is, of course, also possible to design the rollers on the run-out side instead of those on the run-in side, in a detachable manner.

Figure 2:
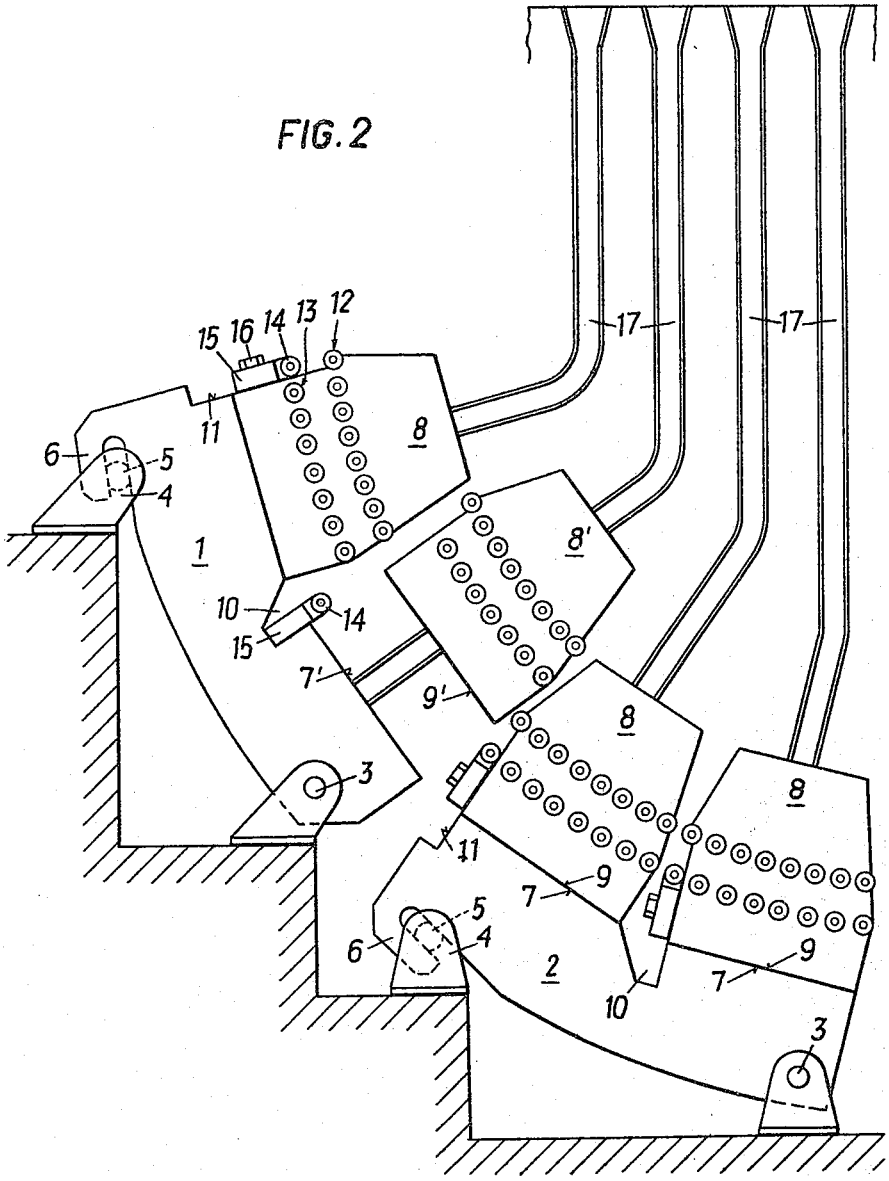
FIG. 2 is a similar representation during the removal of one segment.

The beams 15 in the installed state when ready for casting, as is illustrated in FIG. 1, lie opposite the pockets 10 and 11, respectively. When removing a segment, as is illustrated in FIG. 2, the beam 15 together with the roller 14 is detached from the segment and placed into the pocket 10. Then the segment 8' can be removed by being guided on removal rails 17, whereupon the beam 15 together with the roller 14 can also be removed. This beam 15 with the roller 14 advantageously can be laterally pulled out of the plant. In the workshop, the rollers of the removed segment 8' can be reworked and the roller 14 can be adjusted therewith during this reworking, so that no uneven wear or no places of displacement can occur between the detachable rollers and the rest of the rollers.

The installation of the segment takes place in a reverse manner by pulling the beam 15 together with the roller 14 into the pocket and subsequently introducing the segment via the rails 17. Since the connection holes between the beam 15 and the segment 8' are predrilled, fitting operations at the plant are no longer required. Instead of fit screws, other positive-locking fitting and connecting means can also be used.

What I claim is:

1. In a supporting and guiding strand arrangement to be used in a bow-type continuous casting plant of the type defining an arcuate guide path and including a carrying frame, an inner guideway and an outer guideway arranged opposite each other, enchangeable supporting segments supported on said carrying frame and movable along rails associated with said carrying frame towards an inner side of the arcuate guide path, space being provided between said segments to accommodate such movement, and rollers forming said inner and outer guideway and being mounted in said exchangeable supporting segments at a distance from one another, the improvement which is characterized in that each of said exchangeable supporting segments comprises at least one rim-side roller of said outer guideway which is detachably fastened to said segments, said carrying frame further including a recess defined in said carrying frame and a beam extending transversely to said carrying frame and being detachably fastened to said segment, said rim-side roller being mounted on said beam, said beam being unjournaled with respect to said carrying frame and being displaceable into the recess defined in said carrying frame after detachment from the segment.

2. A supporting and guiding stand arrangement as set forth in claim 1, wherein in the carrying frame is dividedly designed so as to form carrying-frame parts and further comprising a fixed bearing and an expansion bearing for accommodating each of said carrying-frame parts, said expansion bearing being directed concentrically to the arcuate guidepath.

3. A supporting and guiding stand arrangement as set forth in claim 1, wherein the carrying frame is dividedly designed so as to form carrying-frame parts and further comprising a fixed bearing and an expansion bearing for accommodating each of said carrying-frame parts, said expansion bearing being directed tangentially to the arcuate guidepath.

* * * * *

UNITED STATES PATENT AND TRADEMARK OFFICE

CERTIFICATE OF CORRECTION

PATENT NO. : 4,316,494

DATED : Feb. 23, 1982

INVENTOR(S) : Werner Scheurecker

It is certified that error appears in the above—identified patent and that said Letters Patent is hereby corrected as shown below:

Col. 2, line 1, "THE" should read --AN--;

Col. 2, line 64, "enchangeable" should read --exchangeable--.

Signed and Sealed this

*Sixth* Day of *July 1982*

[SEAL]

*Attest:*

GERALD J. MOSSINGHOFF

*Attesting Officer*

*Commissioner of Patents and Trademarks*